United States Patent [19]

Prentiss et al.

[11] 4,327,997

[45] May 4, 1982

[54] CHROME UTILIZATION IN CHROME TANNING

[75] Inventors: William C. Prentiss, New Britain; Inaganti V. Prasad, Hatfield, both of Pa.

[73] Assignee: Rohm and Haas Company, Philadelphia, Pa.

[21] Appl. No.: 176,877

[22] Filed: Aug. 11, 1980

[51] Int. Cl.[3] ..... C14C 3/16; C14C 3/08

[52] U.S. Cl. ..... 8/94.26; 8/94.27; 8/94.33; 252/8.57

[58] Field of Search ..... 8/94.26, 94.27, 94.33; 252/8.57

[56] References Cited

U.S. PATENT DOCUMENTS

| | | | |
|---|---|---|---|
| 1,976,881 | 10/1934 | Harvey | 149/2 |
| 3,668,124 | 6/1972 | Cassella | 252/8.57 |
| 3,765,833 | 10/1973 | Plapper et al. | 8/94.21 |
| 3,860,530 | 1/1975 | Howe | 8/94.16 |
| 3,888,625 | 6/1975 | Dawson | 8/94.27 |
| 3,901,929 | 8/1975 | Cote | 8/94.27 |
| 3,909,193 | 9/1975 | Erdmann et al. | 8/94.33 |
| 3,912,448 | 10/1975 | Howe | 8/94.16 |
| 3,960,481 | 6/1976 | Cote | 8/94.27 |

FOREIGN PATENT DOCUMENTS 1257352 12/1967 Fed. Rep. of Germany .

OTHER PUBLICATIONS

Lollar, R. M., J.A.L.C.A. 35 (10) 584 (1940).
Moore, E. K., J.A.L.C.A. 28 (245 to 259) (1933).
Chem. Abs. (86) 91771(s) (1977) Krawiecki et al.
Chem. Abs. 74502(e), vol. 82 (1975) Erdmann et al.
Chem. Abs. 22609u, vol. 72 (1970) Oleinik et al.
Chem. Abs. 37164c, vol. 70 (1969) Asbeck et al.
Chem. Abs. 139080c, vol. 90 (1979) Mikhanosha et al.
Chem. Abs. 79395m, vol. 81 (1974 Sakiev et al.).
Chem. Abs. 60988g, vol. 76 (1972) "Tanning of Furs and Sheepskins", Metelkin et al., SU-314797, Purim et al.
Chem. Abs. 86627g, vol. 66 (1967) "Development of a National Chrome Tanning", Otto et al.
Chem. Abs. 22905j, vol. 67 (1967) "Improvement of Chrome Tanning of Leather Goods for Shoe Soles", Kolesnikova.
Chem. Abs. 130644y, vol. 92 (1980) "Tanning Rawhide", Okabe et al.
Derwent Abst. 22234 c/13, 3-20-80, Hoechst (DT2839349).
Derwent Abst. 33665 u/24, 5-30-73, Badische (DT2158197).
Derwent Abst. 60050 T/38, 2-7-72 (SU-353500).
Derwent Abst. 40079 T/25, 11-15-71 (SU-314797) Equin. Ref. R".

*Primary Examiner*—Herbert J. Lilling

[57] ABSTRACT

Method of chrome tanning wherein, after unhairing and bating, a water soluble amino compound is provided in an acidified hide stock solution prior to or simultaneously with addition of a chrome tanning agent. The amount of chrome tanning agent required in the charge, and therefore the amount of chrome in the exhaust liquor or effluent, is thereby substantially reduced, thus providing greater control over pollution due to chrome in leather manufacturing operations.

15 Claims, No Drawings

CHROME UTILIZATION IN CHROME TANNING

BACKGROUND OF THE INVENTION

This invention relates to the tanning of animal hides and in particular to the more efficient utilization of chromium tanning compositions.

This application is related to the following copending applications: Ser. No. 052,149, filed June 26, 1979, now U.S. Pat. No. 4,285,689, in the name of Marcel Siegler, entitled "Leather Tanning Composition and Method"; and Ser. No. 052,217, filed June 26, 1979, now U.S. Pat. No. 4,270,912, in the name of William C. Prentiss, entitled "Stabilized Tanning Composition and Method."

Chromium compositions are universally employed as primary tanning agents in the manufacture of leather from animal hides. A typical chromium composition (popularly known as and hereinafter abbreviated to "chrome tan" or "chrome") is a chromium salt solution prepared by reducing sodium bichromate with a sugar or a sugarlike reagent and sulfuric acid. The resulting chrome tan is a basic chromium sulfate, $Cr(OH)SO_4$, having chromium in the trivalent state and having about 25–60% basicity, more usually about 33–40% basicity. Chrome tans have numerous advantages over other tanning agents such as vegetable extracts, synthetic tanning agents (such as phenolic resins) similar in tanning action to vegetable extracts, aldehydes such as formaldehyde and glutaraldehyde, and other mineral tanning agents such as aluminum, iron, titanium and zirconium salts. These advantages include production of a leather more resistant to collagen denaturation and greater control over the tanning process. Chromium salts are also sometimes used in secondary tanning treatments, such as pretanning and retanning (see U.S. Pat. No. 3,888,625), although it is more common to use other tanning agents for such purposes.

The complete tanning process generally comprises both wet and dry operations. The major steps of the wet operations are unhairing (including liming), bating (removal of unhairing chemicals and non-leather making substances), pickling (acidification to maintain the subsequently added chrome tan soluble and addition of brine to prevent acid swelling), and chrome tanning. Secondary wet operations often following the chrome tanning include wringing, splitting and shaving, retanning, coloring, fatliquoring, and setting out. Dry operations follow the wet operations and include drying, conditioning, staking, buffing, finishing, plating, measuring and grading. These and other leather processing technique are thoroughly described in the literature, as in "Leather Facts," New England Tanners Club, Peabody, Mass. (1965).

In chrome tanning, it is known that the chromium may be complexed or "masked" with an organic acid such as formic or acetic acid to increase the pH at which hydrated chromium oxide begins to precipitate from the basic chromium sulfate to above the pH at which the carboxyl groups of the hide collagen begin to ionize and become more receptive to attachment of the chrome complex. Thus, it is known that chrome tanning should begin at a fairly low pH (for example, below about 3.0) to permit the rapid penetration of chrome through the pickled hide, and the tanning should be finished at a higher pH such that the chrome can combine with the collagen and form hydrated chromium oxide-sulfate cross-linked microstructures which provide the stabilized condition in the hide known as "tanning." Formate-masked chrome generally requires a pH of about 3.75 to release the chrome while acetate-masked chrome requires a pH of about 4.25. The pH adjustment, however, should be short of that which will cause precipitation of hydrated chrome oxide since the latter does not play a part in the tanning process and can lead to poor tanning and undesirable side effects.

While there are many variations on chrome tanning, for the purpose of shortening process time, increasing rate of chrome penetration and improving chrome utilization, the variations are for the most part based on pH and temperature control, masking of the chrome, and concentration of chrome in the tanning liquor ("float"). The latter is usually controlled by adding or subtracting water during the tanning process.

Usually, the amount of chrome tan charged is about 1.5% to about 2.0% calculated as $Cr_2O_3$, based on "white weight" (weight of water-swollen hide stock after unhairing and liming but before bating). At the end of tanning, the chrome left over in the tanning liquor usually varies from about 6.0 to about 12.0 g./l. chrome tan as $Cr_2O_3$ as determined by American Leather Chemists Association ("ALCA") Test Method C-1. This exhaust liquor contains chrome in the form of a highly masked, soluble, hydrated, chromium oxide-sulfate complex, and is probably more anionic then cationic in character. At equilibrium about 2.5 to 4.0% chrome tan as $Cr_2O_3$ commonly is fixed in the hide stock on a moisture free basis, as determined by ALCA test method D-10. However, this amounts to only about two-thirds of the chrome being utilized, the balance being discarded in the exhaust liquor.

Although chrome in the trivalent state is nowhere as toxic as hexavalent chrome, it is considered hazardous by regulatory agencies when found in effluent streams. Reducing the amount of chrome in the effluent by increasing the amount of chrome fixed in the hides, that is, improving the efficiency of chrome utilization in chrome tanning, has been the subject of many proposals in recent years. Among the anti-pollution measures practiced may be mentioned re-use of exhaust chrome liquors in pickling and/or tanning, and precipitation of the chrome followed by redissolving and reuse. It is estimated that only about 60% of the chrome in the effluent is recovered for re-use by these procedures, since it is difficult to recover all of the chrome liquor remaining from the tanning step and subsequent processing. Accordingly, recent antipollution measures have concentrated on reducing chrome in the exhaust liquor by improving chrome utilization during the tanning.

A number of chemical methods have been developed to improve the efficiency of chrome utilization. One such method is the use of sparingly soluble neutralizing agents for the acidified chrome tanning bath, such as magnesium oxide and calcium carbonate, rather than readily soluble sodium bicarbonate. By gradually increasing the pH of the float through slow solubilization, and thereby gradually increasing the basicity of the chrome, more chrome is utilized in the tanning process (by avoiding the normal levels of precipitation) than would be the case with rapidly soluble salts. Considerable care is required with these neutralizing agents, however, because with temperature changes, solubility of the neutralizing agent changes and resultant precipitation of chrome within the stock may occur, leading to spots in the leather. Nevertheless, at the higher pH achievable by this technique, the chrome in the exhaust liquor can be reduced to less than one g./l. $Cr_2O_3$ by reducing the chrome charge to 80% of normal. A variation on this process is disclosed in U.S. Pat. No. 3,888,625 wherein exhaust liquor is neutralized by reaction with a sulfite salt and an aldehyde or aldehyde-generating compounds (such as certain oxazolidines).

It is also known to use sparingly soluble dicarboxylic acids, such as adipic or phthalic, as masking agents to increase chrome exhaustion. More soluble acids, such as oxalic, malonic and maleic, are also known to reduce chrome exhaustion. However, it is difficult to achieve uniform penetration of the chrome tan through full thickness hides when using these techniques. The coordination of chrome with alkaline materials such as triethanolamine is also useful for the dechroming of scrap leather. See R. M. Lollar, JALCA, 35, (10) 584(1940).

Another known effort to improve efficient use of chrome is the use of aminocarboxylic chelating agents such as ethylenediaminetetraacetic acid or salts thereof, as in West German Pat. No. 1,257,352 granted July 18, 1968. In this approach a preformed chrome tan chelate is prepared with the chelating agent at a low pH where it is stable. The chelate is then applied to limed hide stock or hide stock washed out of bate and still alkaline, at which pH the chrome chelate becomes unstable and tanning takes place with the formation of the calcium chelate reaction product (from lime still in the bated stock). Because of the resultant high pH, there will be less chrome in the exhaust liquor. However, again because of the high pH, it is difficult to achieve good penetration and uniform distribution of the chrome tan in the hide.

Because of the multiplicity of steps and complexity of the total leather manufacturing process, the tanning industry is reluctant to make any significant change in a key step, such as the chrome tanning step, in view of the possibility that such change will upset their long established control over the other steps and therefore the quality of the leather. Accordingly, it has been the tendency in the industry to recycle or precipitate effluent chrome rather than to make changes in the chrome tanning step. Precipitation and recycling of course, substantially add to the complexity and cost of the total process. The industry most likely, therefore, would find acceptable an improvement which would reduce chrome in the effluent so long as no significant changes are required in the chrome treatment step and the quality of the leather is not lessened.

SUMMARY OF THE INVENTION

It has now been found that a chrome tan can be utilized more efficiently in the tanning of animal hides, thereby reducing the amount of chrome required in the charge and found in the exhaust liquor, by providing in the acidified medium containing the hide stock and chrome tan, after unhairing and bating, a water soluble amino compound. The amino compound is one which per se has substantially no tanning properties but which is capable of enhancing the tanning afforded by a chrome tan. By this means not only may the amount of chrome tan charged for effective tanning be decreased with consequent lower chrome in the exhaust, but also no substantial changes are required in the conventional tanning process and the noxious conditions resulting from the use of aldehydes or the generation of aldehydes by pretanning agents or auxiliaries are avoided.

DETAILED DESCRIPTION

The amino compounds useful in this invention are those non-toxic, water soluble, amino functionality containing compounds which provide no substantial tanning action when used alone but which augment the tanning action of chrome tanning agents. For the purpose of this invention, "water soluble" includes "water solubilizable," that is, the capability of becoming water soluble upon the addition of solubilizing agents such as surfactants, emulsifiers and the like. Excluded from the amino compounds of the invention are the amino compound tanning agents of the above-identified copending patent applications Ser. Nos. 052,149 and 052,150. The latter applications cover certain amino compounds preferably used as non-chrome pretanning agents and probably tan by the generation of an aldehyde, as indicated by an aldehyde odor. The present invention thus avoids the possibility of discomfort or toxic effects due to aldehyde.

The amino compounds of the present invention include a variety of compounds containing amino functionality, both polymeric and nonpolymeric. The nonpolymeric amino compounds generally are aliphatic, including cycloaliphatic, compounds such as primary, secondary and tertiary mono- and polyamines, and salts thereof, such as salts formed with mineral acids such as sulfuric and hydrochloric acid, and organic (mono- and polycarboxylic) acids such as acetic, formic and phthalic acid. The amines may also carry other functional groups which contribute to the water solubility, such as hydroxyl and/or carboxyl groups. Accordingly, the amines include alkylamines, alkanolamines, and aminocarboxylic acids and aminopolycarboxylic acids, in each case both aliphatic and cycloaliphatic.

The aminopolycarboxylic acids include those of the formula:

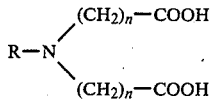

wherein R is:

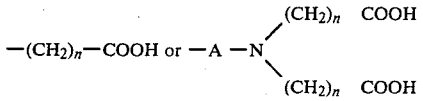

wherein n is 1 or 2, A is a low molecular weight aliphatic or cycloaliphatic moiety, particularly a 1,2-cyclohexylene moiety or a moiety of the formula

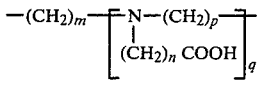

wherein m and p are either 2 or 3, and q is 0, 1 or 2. Examples of the foregoing aminopolycarboxylic acids are nitrilotriacetic acid, nitrilotripropionic acid, ethylenediaminotriacetic acid, ethylenediaminotetraacetic acid, propylenediaminotetraacetic acid, ethylenediaminotetrapropionic acid, diethylenetriaminotetra- or pentaacetic acid, and 1,2-cyclohexylenediaminotetraacetic acid.

Aminopolycarboxylic acids of the foregoing types are described in West German Pat. No. 1,257,352 published July 18, 1968. The mineral acid or organic acid salts of the foregoing aminocarboxylic acids are also useful in accordance with the present invention.

Specific alkyl amines and alkanolamines useful in the present invention are primary amines such as 2-amino-2-methylpropanol-1, t-butylethanolamine and 2[2-ethylamino]ethanol; secondary amines, such as N-methylethanol amine and diethanol amine; tertiary amines, such as triethyl amine and triethanol amine; alkylenepolyamines such as ethylene diamine, diethylenetriamine, triethylenepentamine and the like; and condensates of alkylamines with an alkylene oxide such as ethylene oxide, such as compounds of the formula t—RNH $(CH_2CH_2O)_xH$ wherein R is mixed alkyl containing about 12 to 24 carbon atoms and x is in the range of about 1 to 30. Typical of such condensates are t—$C_{12-14}$NH $(CH_2CH_2O)_yH$, wherein y varies from about 1 to 15 and t—$C_{18-22}$NH $(CH_2CH_2O)_{25}$, such series being commercially available under the trademarks "Triton RW" and "Priminox T," respectively. A similar condensate is the amino compound sold under the trademark "Jeffamine D-400" and described as the bis-2-aminopropyl ether of an ethoxy diol wherein the diol has a molecular weight of about 400.

Preferred amino compounds are those which are water soluble without the addition of solubilizing agents, which are essentially odorless, and which remain stable over the pH range of the chrome tanning step, from an acid pH when the pickled hide stock is first contacted with the chrome tan to the neutral or slightly alkaline pH during chrome fixation.

No substantial deviation is required from normal tanning operations when practicing the present invention. The amino compound can be added neat or in aqueous solution, in either free amine form or after neutralization with a mineral or organic acid, to the aqueous medium containing an acidified hide stock, or to the hide stock prior to or simultaneously with acidification or after acidification but prior to addition of the chrome tan, or simultaneously with addition of the chrome tan to the acidified hide stock. Thus, as a general rule, the amino compound is provided in the acidified medium which contains or will contain the chrome tan, so that it operates as an assist or auxiliary to the chrome tan. Preferably, the amino compound is added to the aqueous medium containing the hide stock after acidification but before addition of the chrome.

Conventionally, the acidified chrome tan hide stock solution will have a pH in the range of about 1.5 to 4.5, preferably about 1.8 to 2.5. From about 0.01 wt. % to about 5.0 wt. % of the amino compound based on white weight may be used but optimum amounts will depend upon the amount of chrome tan and other variables and may be determined by routine trial. In accordance with preferred embodiments of the invention, only about 1.0 wt. % to about 1.25 wt. % (on white weight) of chrome tan calculated as $Cr_2O_3$ is required in the charge to the hide stock, when about 0.1 wt. % to about 2.0 wt. % (on white weight) of amino compound also is present, as compared to 1.5% or more chrome tan when no amino compound is added. Accordingly, without the amino compound, higher amounts of chrome tan would be required for equivalent tanning, and the discharge would have a substantially higher chrome content.

Among some specific variations on utilizing the amino compounds in accordance with the invention are the following alternative sequences. In each sequence a hide stock in an aqueous medium is bated, washed out of bate and acidified according to standard practice. The float is then adjusted to the desired level and the chrome tanning process commenced. Also, in each sequence, the acidification is a "pickle," in that brine is added before the pH adjustment in order to prevent acid swelling of the hides. The invention can be practiced without brine addition, however. Moreover, the reagents may be added sequentially, alternating with drumming, or premixed and added as a composite.

1. Add amine, drum (i.e. agitate in a revolving drum), add salt (NaCl), drum, add sulfuric acid to pickle, drum, add sodium formate and basic chrome sulfate, drum, and neutralize.

2. Add salt, drum, add sulfuric acid, drum, add amine, drum, add sodium formate and basic chrome sulfate, drum, and neutralize.

3. Add salt, drum, add formic acid, drum, add amine, drum, add sulfuric acid, drum, add basic chrome sulfate, drum, and neutralize.

4. Add salt, drum, add sodium formate and sulfuric acid, drum, add amine, drum, add basic chrome, drum, and neutralize.

5. Add salt, drum, add sulfuric acid, drum, add amine, sodium formate and basic chrome sulfate, drum, and neutralize.

The following Table I summarizes typical ranges, in wt. % based on white weight, for concentrations of active ingredients in practicing the present invention on full thickness hides. While these ranges represent the more usual commercial practice, it will be understood that amounts outside these ranges will be effective, since the tanning process involves multiple variables, including the type of chrome tan and amino compound, pH, temperature, duration of agitation of stock, other additives in the solution, and hide thickness.

TABLE I

| | Typical Ranges | | |
|---|---|---|---|
| | Min. | Max | Preferred |
| Float | 10% | 150% | 40%–50% |
| Amino compound | 0.1% | 2.0% | 0.2%–0.4% |
| Salt (NaCl) | 3° Be | 10° Be | 4–7° Be |
| $H_2SO_4$(95%) | 1% | 2% | 1.25%–1.75% |
| Sodium formate | 0.0% | 2% | 0.5%–1.25% |
| Basic chrome sulfate, as $Cr_2O_3$ | 1.0% | 1.5% | 1.2%–1.3% |
| Sodium bicarbonate | - as needed to neutralize | | |

While the mechanism by which the present invention operates is not known, it is believed that since chrome tanning depends upon reaction of the chrome with available carboxyl groups in the collagen of the hide stock, the amino compound probably blocks this reaction temporarily so that the chrome will more readily penetrate into the stock before combining. Blocking action is reversible, depending upon amino compound concentration and pH.

The invention is applicable to the chrome tanning of animal hides of all types, including bovine, ovine and marsupial, such as cattle, sheep, pigs, goats and reptiles. For the purposes of this specification, "hides" includes full thickness animal pelts as well as skins. The invention is especially beneficial for the chrome tanning of full thickness hides because it aids in overcoming the difficulty of penetration and exhaustion of chrome, but it is also applicable to the tanning of light weight stock such as lime split hides. The invention may also be practiced in conjunction with various other leather manufacturing processes known in the art. For example, the invention may be practiced in pretanning and with mixed tannages, such as one or more of a vegetable, synthetic, aldehydic or other mineral tan, in admixture or in combination with a chrome tan.

The following examples wherein all parts and percentages are by weight unless otherwise specified, are intended as further illustration of the invention without necessarily limiting the scope thereof. Among the benefits shown by the examples is that whereas a standard, masked chrome tanage utilizes only about 60% of the chrome tan charged (as $Cr_2O_3$), the balance being discharged to a waste stream, the present invention improves the chrome tan utilization to about 90% so that the chrome tan charged can be reduced by 20 to 25%. The chrome content of the discharge is therefore significantly reduced so that treatment to recover and/or recycle the chrome is easier and uncontrolled loss to a waste stream is reduced. Moreover, since a leather product produced in accordance with the invention will contain the normal chrome content with minimal content of amino compound, the susceptibility of the leather to retanning and subsequent processing will be changed minimally or not at all.

EXAMPLE 1

1000 g. of limed cowhide stock was delimed and bated using a conventional procedure. The delimed and bated stock was washed for 10 minutes and floated in 1000 cc. of 3% sodium chloride solution. The stock was drummed for 10 minutes and then 7.5 g. formic acid (diluted 1 to 5 with water) was added, followed by a 30 minute drumming. The solution and the stock had a pH of 4.8 and 6–6.25, respectively. To the mixture was added 10 g. of an aqueous diethanolamine sulfate solution (30% diethanolamine, "DEA"), followed by drumming for two hours. At the end of the run, the pH of the bath was lowered by adding 2.5 g. sulfuric acid. The stock was drummed for 10 minutes and the solution had a pH of 3.8. 12.5 g. (1.25% on white weight) $Cr_2O_3$ (50% solution of basic chromium sulfate, sold under the trademark "Koreon M") was added and the mixture drummed for 2½ hours. The final pH's of the solution and the stock were 3.9 and 4–4.25, respectively. The blue stock stood a one minute boil without shrinking thus indicating full tanning. The $Cr_2O_3$ in the spent liquor was 2.4 g./l.

EXAMPLE 2

1000 g. of limed cowhide stock was delimed and bated using a conventional procedure. The bated stock was washed for 10 minutes and floated in 1000 cc. of 5% sodium chloride solution. The stock was drummed for 10 minutes and then 20 g. sulfuric acid (diluted 1 to 10 with water) was added followed by a 2 hr. drumming. The stock was left standing overnight in the liquor. By next morning the solution and the stock had a pH of 2.2 and 2.25–2.50, respectively. To the liquor containing the stock was added 10 g. of an aqueous diethanolamine sulfate solution (30% DEA), followed by drumming for 30 minutes. At the end of the run 10 g. sodium formate (dry) was added, followed by drumming for 30 minutes. 12.5 g. (1.25% on white weight) $Cr_2O_3$ (Koreon M in the form of 50% solution) was added and the mixture drummed for 30 minutes. The stock was checked for complete penetration of chrome and then neutralized with sodium bicarbonate (10% solution) to a liquor pH of 3.7–3.8 and a stock pH of 4–4.25. The total run in chrome liquor was 2½ hrs. The blue stock stood a one minute boil. The $Cr_2O_3$ in spent liquor was 1.2 g./l. as compared with 4.2 g./l. under essentially the same conditions but without the diethanolamine sulfate.

EXAMPLE 3

1000 g. of limed cowhide stock was delimed and bated using a conventional procedure. The delimed and bated stock was washed and floated in a 1000 ml. of 3% sodium chloride solution. The stock was drummed for 10 minutes and then 30 g. glacial acetic acid (diluted 1 to 5 with water) was added, followed by a three hour drumming. The stock was let stand overnight in the pickle liquor. The solution and the stock had a pH of 4.5 and 5–5.25, respectively. To this mixture was added 10 g. of a 30% aqueous diethanolamine sulfate solution, followed by drumming for two hrs. At the end of the run 12.5 g. (1.25% on white weight) $Cr_2O_3$ (Koreon M in the form of 50% solution) was added and the mixture drummed for 2½ hrs. The pH of the solution was 4.2 with a stock pH of 4–4½. The blue stock stood a one minute boil. The $Cr_2O_3$ in spent liquor was 3.3 g./l.

EXAMPLE 4

Comparative

Example 2 was repeated in all essential respects except for the absence of the diethanolamine sulfate solution and the presence of 1.5% $Cr_2O_3$. This is the level of $Cr_2O_3$ in conventional chrome tanning. The $Cr_2O_3$ in the spent liquor was 5.4 g./l. The stock stood a one minute boil.

EXAMPLE 5

Table II below shows the effect of concentration of diethanolamine sulfate solution (30% DEA) or as diethanolamine (DEA) on the amount of chrome (as $Cr_2O_3$) remaining in the spent chrome tan liquor in a tanning procedure essentially as described in Example 2. It will be noted that although the chrome in the effluent was reduced from 4.2 g./l. to 1.6 g./l., at the lowest diethanolamine sulfate concentration tested (0.1% DEA), the leather did not stand the boil. Therefore, the minimum concentration of this amino compound for optimum results is about 0.2% as DEA on white weight or some concentration between about 0.2% and 0.1%. There was a substantial reduction in the chrome in the effluent in all cases, nevertheless.

TABLE II

| % Diethanolamine sulfate solution (30%), (as % DEA) | $Cr_2O_3$ charge % | $Cr_2O_3$ discharge g./l. | Withstood boil one minute |
|---|---|---|---|
| 0.33 (0.1) | 1.25 | 1.6 | no |
| 0.66 (0.198) | 1.25 | 1.5 | yes |
| 1.70 (0.51) | 1.25 | 2.0 | yes |
| 2.50 (0.75) | 1.25 | 2.5 | yes |
| 3.30 (0.99) | 1.25 | 2.6 | yes |
| control (0.00) | 1.25 | 4.2 | yes |

EXAMPLES 6–17

Table III below summarizes test results for various amino compounds using a chrome tanning procedure essentially as described in Example 2. From these test results it can be seen that the $Cr_2O_3$ charge can be reduced from 1.5% to 1.25% or less when the amino compound is present.

| Ex. | Amino compound % (as free amine) on white weight | $Cr_2O_3$ charge, % | $Cr_2O_3$ discharge g./l. | withstand boil 1 minute |
|---|---|---|---|---|
| 6. | 2-amino-2-methyl propanol-1, 1% | 1.25 | 1.5 | yes |
| 7. | triethylamine, 1% | 1.25 | 2.0 | yes |
| 8. | N-methylethanolamine 1% | 1.25 | 3.0 | yes |
| 9. | triethanolamine, 0.3% | 1.25 | 1.6 | yes |
| 10. | 2[2-ethylamino]ethanol, 0.3% | 1.25 | 3.3 | yes |
| 11. | bis-2-aminopropyl[1] polyethoxyethanol, 0.3% | 1.25 | 3.9 | yes |
| 12. | t-$C_{12-14}$ aminoethanol[2], 0.3% | 1.25 | 3.3 | yes |
| 13. | diethylenetriamine, 0.3% | 1.25 | 3.0 | yes |
| 14. | t-butylethanolamine, 0.3% | 1.25 | 2.3 | yes |
| 15. | diethanolamine lauryl sulfate[3] 0.30% | 1.25 | 3.3 | yes |
| 16. | sodium ethylene diamino tetraacetate, 0.02% | 1.25 | 3.4 | yes |
| 17. | sodium ethylene diamino tetraacetate, 0.2% | 1.25 | 2.0 | yes |
| | control - none - | 1.25 | 4.2 | yes |
| | control - none - | 1.5 | 5.4 | yes |

[1]Jeffamine D-400, Jefferson Chemical Company
[2]Triton RW-10, Rohm and Haas Company
[3]Standapol, Henkel Chemicals Corp.

EXAMPLE 18

1000 g. of limed cowhide was delimed and bated using a conventional procedure. The bated stock was washed for 10 minutes and floated in 1000 cc. of 5% sodium chloride solution. The stock was drummed for 10 minutes and then 20 g. of sulfuric acid (diluted 1 to 10 with water) was added followed by a 2 hr. drumming. The stock was left standing overnight in the liquor. By next morning the solution and the stock had a pH of 2.5 and 2.5–2.75, respectively. To the liquor containing the stock was added 10 g. of an aqueous diethanolamine sulfate solution 30% DEA). The addition was followed by drumming for 30 minutes. At the end of the run 10 g. of sodium formate was added (as a 10% aqueous solution) immediately followed by addition of 12.5 g. (1.25% on white weight) $Cr_2O_3$ (Koreon M in the form of 50% solution). The mixture was then drummed for 30 minutes. The stock was checked for complete penetration of chrome and then neutralized with sodium bicarbonate (10% solution) to a liquor pH of 3.9 and a stock of 4.0–4.25. The total run in the chrome liquor was 2½ hours. The resulting blue stock stood a one minute boil. The $Cr_2O_3$ in the spent liquor was 1.4 g./l.

EXAMPLE 19

1000 g. of limed cowhide stock was delimed and bated using a conventional procedure. The bated stock was washed for 10 minutes and floated in 1000 cc. of 5% sodium chloride solution. The stock was drummed for 10 minutes and then 20 g. of sulfuric acid (diluted 1 to 10 with water) was added followed by a 2 hr. drumming. The stock was left standing overnight in the liquor. By next morning the solution and stock had a pH of 2.5 and 2.5–2.75, respectively. To the liquor containing the stock was added 10 g. of an aqueous diethanolamine sulfate solution (30% DEA), immediately followed by 10 g. of sodium formate (as a 10% aqueous solution) and 12.5 g. (1.25% on white weight) $Cr_2O_3$ (Koreon M in the form of a 50% solution). The mixture was then drummed for 30 minutes. The stock was checked for complete penetration of chrome and then neutralized with sodium bicarbonate (10% solution) to a liquor pH of 3.9 and a stock pH of 4.0–4.25. the total run in the chrome liquor was 2½ hours. The resulting blue stock stood a one minute boil. The $Cr_2O_3$ in the spent liquor was 1.1 g./l.

We claim:

1. In a tanning method wherein an aqueous medium containing hide stock is unhaired, bated and acidified, and a chrome tan is charged to the acidified medium to effect tanning of the hide stock, the improvement which comprises providing in the acidified aqueous medium prior to or simultaneously with addition of the chrome tan, a water soluble amino compound which has no tanning properties of its own but which is capable of enhancing the tanning afforded by a chrome tan in an amount effective to permit reduction in the chrome tan charge while obtaining an equivalent level of tanning.

2. The tanning method of claim 1 wherein the amino compound is selected from primary, secondary and tertiary amines and salts thereof.

3. The tanning method of claim 1 wherein the aqueous medium is acidified to a pH of about 1.5 to 4.5.

4. The tanning method of claim 1 wherein the aqueous medium is acidified to a pH of about 1.8 to 2.5.

5. The tanning method of claim 1 wherein the amount of amino compound is about 0.01–5.0 weight % based on the white weight of the hide stock.

6. The tanning method of claim 1 wherein the amino compound is an alkylamine, an alkanolamine or salt thereof.

7. The tanning method of claim 1 wherein the amino compound is triethylamine, diethylene triamine, 2-amino-2-methyl-propanol-1, diethanolamine, triethanolamine, N-methylethanolamine, 2[2-ethylamino]ethanol, bis-2-aminopropyl polyethoxy ethanol, t-($C_{12}$-$C_{14}$)aminoethanol, t-butylethanolamine, ethylenediaminetetraacetic acid, or salt thereof.

8. The tanning method of claim 1 wherein the amino compound is added to the aqueous medium after acidification and prior to addition of the chrome tan.

9. The tanning method of claim 1 wherein the amino compound is diethanolamine or a salt thereof.

10. The tanning method of claim 1 wherein the amino compound is an alkylamine, an alkanolamine or salt thereof, the hide stock in the aqueous medium is pickled to a pH of about 1.5 to 4.5, the amino compound is added to the aqueous medium after pickling, and the amount of amino compound is about 0.1–2.0 wt. % based on the white weight of the hide stock.

11. The tanning method of claim 10 wherein the amino compound is diethanolamine or salt thereof.

12. The tanning method of claim 10 wherein the amino compound is ethylenediaminetetraacetic acid or a salt thereof.

13. The tanning method of claim 10 wherein the amino compound is 2-amino-2-methyl propanol-1 or a salt thereof.

14. The tanning method of claim 10 wherein the amino compound is triethylamine or a salt thereof.

15. The tanning method of claim 10 wherein the amino compound is N-methylethanolamine or a salt thereof.

* * * * *